United States Patent [19]

Mair

[11] Patent Number: 5,072,429

[45] Date of Patent: Dec. 10, 1991

[54] ELECTRONIC WAKE UP PILLOW

[76] Inventor: Izehak Mair, 17935 NE. 19th Ave., North Miami Beach, Fla. 33162

[21] Appl. No.: 651,522

[22] Filed: Feb. 6, 1991

[51] Int. Cl.[5] ..... G04B 47/00; A47G 9/00

[52] U.S. Cl. ..... 368/10; 368/12; 5/434

[58] Field of Search ..... 368/10, 12, 278, 250, 368/255; 5/434

[56] References Cited

U.S. PATENT DOCUMENTS

| | | | |
|---|---|---|---|
| 4,028,882 | 6/1977 | Muncheryan | 368/12 |
| 4,093,944 | 6/1978 | Muncheryan | 368/12 |
| 4,352,169 | 9/1982 | Asano | 368/250 |
| 4,920,525 | 4/1990 | Meister | 368/250 |
| 4,972,533 | 11/1990 | Brown | 5/434 |

FOREIGN PATENT DOCUMENTS

| | | | |
|---|---|---|---|
| 2405771 | 8/1975 | Fed. Rep. of Germany | 368/12 |

*Primary Examiner*—Vit W. Miska

*Attorney, Agent, or Firm*—Richard L. Miller

[57] ABSTRACT

An electronic wake up pillow for alerting a person to a present time is provided and consists of a cloth case, stuffed with soft material used to cushion a head of the person, especially during sleep and an electronic alarm system built into the stuffed cloth case for delivering a personal alarm sound perceptible only to the person. The alarm sound is responsive to the present time so that the electronic alarm system will deliver the alarm sound to the proximity of the ears of the person resting on the pillow.

3 Claims, 1 Drawing Sheet

ELECTRONIC WAKE UP PILLOW

BACKGROUND OF THE INVENTION

The instant invention relates generally to alarm devices and more specifically it relates to an electronic wake up pillow.

Numerous alarm devices have been provided in the prior art that are adapted to alert the users of the alarm devices and others in close proximity to the alarm devices. For example, U.S. Pat. No. 4,821,247 to Grooms is illustrative of such prior art. While these units may be suitable for the particular purpose to which they address, they would not be as suitable for the purpose of the present invention as hereafter described.

SUMMARY OF THE INVENTION

A primary object of the present invention is to provide an electronic wake up pillow that will overcome the shortcomings of the prior art devices.

Another object is to provide an electronic wake up pillow which will alert a person sleeping on the pillow without disturbing others nearby.

An additional object is to provide an electronic wake up pillow in which all the components needed for operating the alarm in the pillow is built into the pillow for the convenience of the person sleeping on the pillow.

A further object is to provide an electronic wake up pillow that is simple and easy to use.

A still further object is to provide an electronic wake up pillow that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
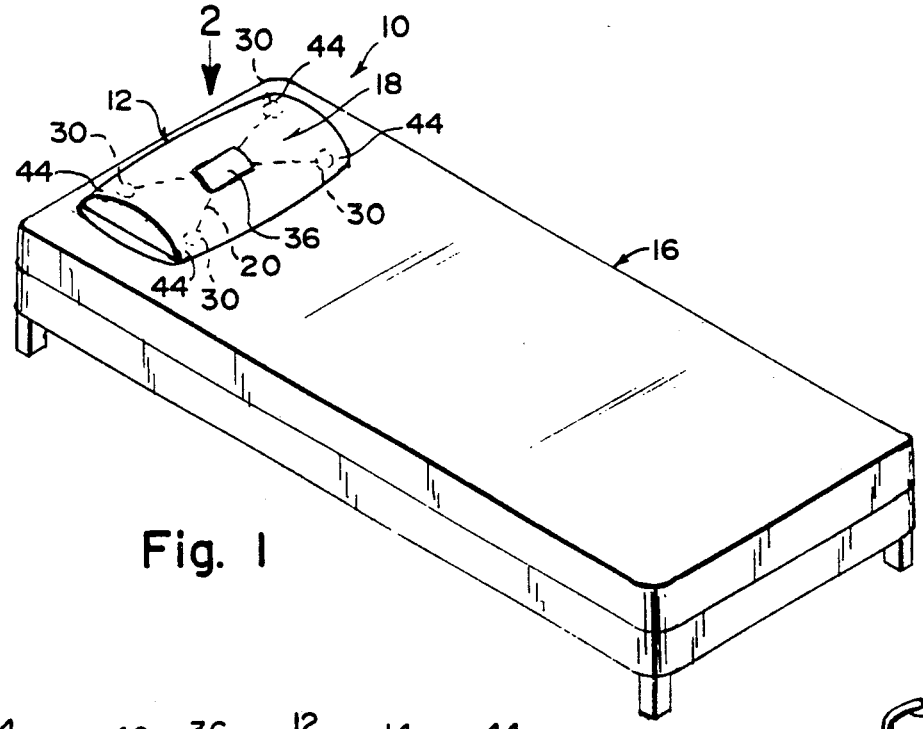
FIG. 1 is a perspective view of the invention placed upon a bed.
Figure 2:
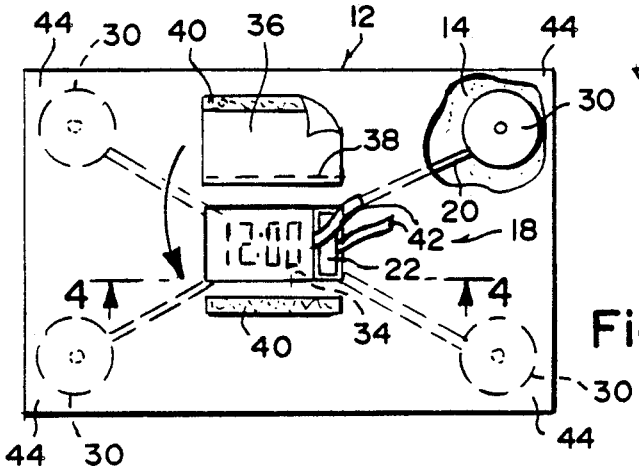
FIG. 2 is a top view as indicated by arrow 2 in FIG. 1 with parts broken away.
Figure 4:
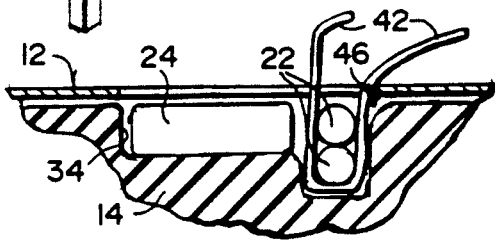
FIG. 4 is an enlarged cross sectional view with parts broken away taken on line 4—4 of FIG. 3.
Figure 3:
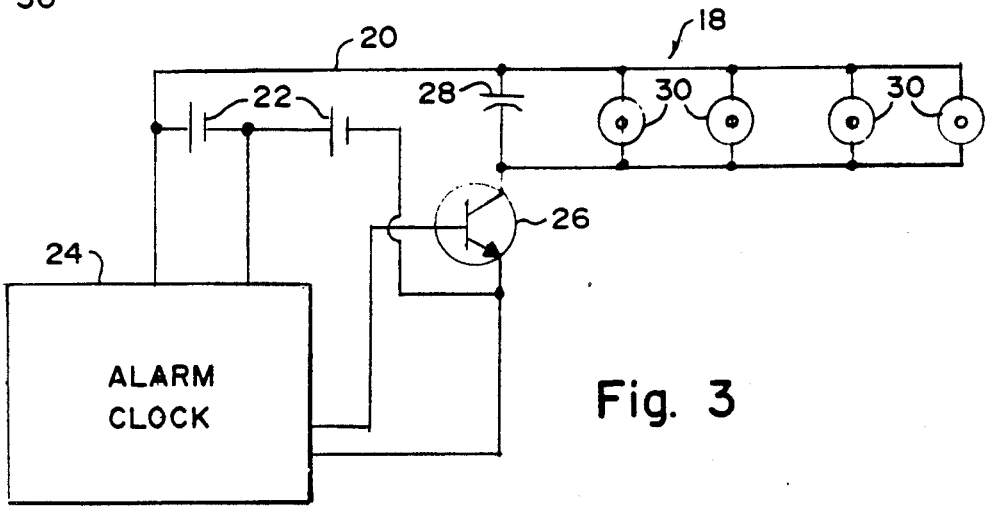
FIG. 3 is a schematic view of the electrical circuit thereof.

Turning now descriptively to the drawings, in which like reference characters denote like elements throughout the several views, the Figures illustrate an electronic wake up pillow 10 for alerting a person (not shown) to a present time. The pillow 10 consists of a cloth case 12, stuffed with a soft material 14, such as down, feathers, foam rubber or the like, used to cushion a head of the person on a bed 16 or the like, especially during sleep. An electronic alarm system 18 is built into the stuffed cloth case for delivering a personal alarm sound perceptible only to the person resting on the pillow 10. The alarm sound is responsive to the present time so that the electronic alarm system 18 will deliver the alarm sound to the proximity of the ears of the person.

The electronic alarm system 18 includes an electronic circuit 20 connected to at least one battery 22. A digital alarm clock 24, and typically a transistor 26 used as a switching device, a capacitor 28 and at least one piezo-electric sounder 30 are all connected to the electronic circuit 20 to produce the alarm sound.

The cloth case 12 has a front aperture 32 and a pocket 34 formed within the soft material 14 to hold the, at least one battery 22 and the digital alarm clock 24 therein. A flap 36 is affixed at 38 to the cloth case 12 above the front aperture 32 to cover the pocket 34. Hook and loop pile mating fabric fastener strips 40 are attached to the back of the flap 36 and the cloth case 12 below the front aperture 32 to hold the flap 36 closed over the pocket 34.

A cloth tape 42 is secured to the case 12 by stitching 46 and is inserted in the pocket 34 about the at least one battery 22 so that when the flap 36 is opened the cloth tape 42 can be pulled to release the at least one battery 22 from the pocket 34. A typical design illustrated shows two batteries 22 are in the pocket 34 and four piezo-electric sounders 30 one secured in each corner 44 of the cloth case 12.

To use the electronic wake up pillow 10 the person simply opens the flaps 36 and connects the batteries 22 to the electronic circuit 20 and sets the digital alarm clock 24 to the proper time. The flap 26 is then closed with the hook and loop fabric fastener strips 40 placed in engagement with each other. The pillow 10 is then placed under the head of the person on the bed. When the proper time is reached the alarm sound will be activated to only wake up the person.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An electronic wake up pillow for alerting a person to a present time, said pillow comprising:

(a) a rectangular cloth case, stuffed with a soft material used to cushion a head of a person, especially during sleep; and (b) an electronic alarm system built into said stuffed cloth case for delivering a personal alarm sound perceptible only to the person, the alarm sound being responsive to the present time; said electronic alarm system including:

(c) an electronic circuit connected to at least one battery;

(d) a digital alarm clock connected to at said electronic circuit;

(e) a transistor connected to said electronic circuit;

(f) a capacitor connected to said electronic circuit; and (g) a plurality of piezo-electric sounders received in respective corners of the cloth case and connected to said electronic circuit to produce the alarm sound so that said electronic alarm system will deliver the alarm sound to the proximity of the ears of the person.

2. An electronic wake up pillow as recited in claim 1, wherein said soft material can include down, feathers, and foam rubber.

3. An electronic wake up pillow as recited in claim 1, further including:

(a) said cloth case having a front aperture and pocket formed within the soft material to hold said at least one battery and said digital alarm clock therein;

(b) a flap affixed to said cloth case above said front aperture to cover said pocket;

(c) hook and loop pile mating fabric fastener strips attached to the back of said flap and said cloth case below said front aperture to hold said flap closed over said pocket; and (d) a cloth tape insertable in said pocket about said at least one battery so that when said flap is opened said cloth tape can be pulled to release said at least one battery from said pocket.

* * * * *